US011504969B2

(12) United States Patent
Arafuka et al.

(10) Patent No.: US 11,504,969 B2
(45) Date of Patent: Nov. 22, 2022

(54) WIPING DEVICE, LIQUID EJECTING APPARATUS

(71) Applicant: SEIKO EPSON CORPORATION, Tokyo (JP)

(72) Inventors: Kazushi Arafuka, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/233,926

(22) Filed: Apr. 19, 2021

(65) Prior Publication Data

US 2021/0323309 A1 Oct. 21, 2021

(30) Foreign Application Priority Data

Apr. 21, 2020 (JP) ..... JP2020-075452

(51) Int. Cl.
*B41J 2/165* (2006.01)

(52) U.S. Cl.
CPC ..... *B41J 2/16544* (2013.01); *B41J 2/16508* (2013.01); *B41J 2/16535* (2013.01); *B41J 2002/1655* (2013.01)

(58) Field of Classification Search
CPC ..... B41J 2/16544; B41J 2/16508; B41J 2/16535; B41J 2002/1655
See application file for complete search history.

(56) References Cited

U.S. PATENT DOCUMENTS

| | | | | |
|---|---|---|---|---|
| 9,308,730 | B2 * | 4/2016 | Maida | B41J 2/16535 |
| 2013/0120495 | A1 | 5/2013 | Nakamura et al. | |
| 2013/0222475 | A1 | 8/2013 | Inoue | |
| 2013/0222476 | A1 | 8/2013 | Inoue | |
| 2014/0132667 | A1 | 5/2014 | Shinoto et al. | |

FOREIGN PATENT DOCUMENTS

| | | | |
|---|---|---|---|
| JP | 2007-307915 | A | 11/2007 |
| JP | 2010-224340 | A | 10/2010 |
| JP | 2013-103377 | A | 5/2013 |
| JP | 2013-173244 | A | 9/2013 |
| JP | 2013-173245 | A | 9/2013 |
| JP | 2014-094542 | A | 5/2014 |
| JP | 2015-120268 | A | 7/2015 |
| JP | 2019-043031 | A | 3/2019 |

* cited by examiner

*Primary Examiner* — Geoffrey S Mruk
(74) *Attorney, Agent, or Firm* — Workman Nydegger

(57) ABSTRACT

A wiping device includes a feeding portion having a feeding shaft, and configured to hold a band-like member, a pressing unit configured to allow a contact portion located in a contact region of the band-like member, to be brought into contact with a liquid ejecting portion, a winding portion having a winding shaft, and configured to be capable of performing a winding operation for winding the band-like member to move the contact portion in a movement direction, a brake mechanism configured to brake rotation of the feeding shaft, and a contact unit configured to contact the band-like member fed from the feeding portion and to apply tension to the band-like member, the contact unit being movable between an operating time position during the winding operation and a stop time position when the winding operation is not performed.

14 Claims, 5 Drawing Sheets

WIPING DEVICE, LIQUID EJECTING APPARATUS

The present application is based on, and claims priority from JP Application Serial Number 2020-075452, filed Apr. 21, 2020, the disclosure of which is hereby incorporated by reference herein in its entirety.

BACKGROUND

1. Technical Field

The present disclosure relates to a wiping device, and a liquid ejecting apparatus including a wiping device.

2. Related Art

For example, as in JP 2007-307915 A, there is a droplet discharging device that is an example of a liquid ejecting apparatus, that includes a wiping unit that is an example of a wiping device that wipes a function droplet discharging head that is an example of a liquid ejecting portion with a wiping sheet that is an example of a band-like member. The wiping unit includes a feeding reel that is an example of a feeding shaft for feeding the wiping sheet that is an example of the band-like member, a winding reel that is an example of a winding shaft for winding the wiping sheet, and a wiping roller that is an example of a pressing unit provided between the feeding reel and the winding reel.

The wiping unit drives a winding motor to wind the wiping sheet around the winding reel, and applies tension to the wiping sheet by braking the feeding reel with a torque limiter that is an example of a brake mechanism.

When the band-like member is wound by rotating the winding shaft while applying tension to the band-like member, slack may occur in the band-like member between a feeding portion and the winding portion when the winding shaft stops rotating.

SUMMARY

A wiping device for solving the above-described problem includes a feeding portion having a feeding shaft, and configured to hold a band-like member in a state of being wound in a roll shape, a pressing unit around which the band-like member fed from the feeding portion is wound, the pressing unit being configured to enable a contact portion, located in a contact region, of the band-like member to contact a liquid ejecting portion configured to eject liquid, a winding portion having a winding shaft, and configured to be capable of performing a winding operation for winding the band-like member to move the contact portion in a movement direction, a brake mechanism configured to brake rotation of the feeding shaft in a direction in which the band-like member is fed from the feeding shaft, and a contact unit configured to contact the band-like member fed from the feeding portion in a movement region between the feeding portion and the winding portion in the movement direction to apply tension to the band-like member, the contact unit being movable between an operating time position during the winding operation and a stop time position when the winding operation is not performed.

A liquid ejecting apparatus for solving the above-described problem includes a liquid ejecting portion configured to eject liquid, and a wiping device capable of wiping the liquid ejecting portion, wherein the wiping device includes a feeding portion having a feeding shaft, and configured to hold a band-like member in a state of being wound in a roll shape, a pressing unit around which the band-like member fed from the feeding portion is wound, the pressing unit being configured to enable a contact portion, located in a contact region, of the band-like member to contact a liquid ejecting portion, a winding portion having a winding shaft, and configured to be capable of performing a winding operation for winding the band-like member to move the contact portion in a movement direction, a brake mechanism configured to brake rotation of the feeding shaft in a direction in which the band-like member is fed from the feeding shaft, and a contact unit configured to contact the band-like member fed from the feeding portion in a movement region between the feeding portion and the winding portion in the movement direction to apply tension to the band-like member, the contact unit being movable between an operating time position during the winding operation and a stop time position when the winding operation is not performed.

DESCRIPTION OF EXEMPLARY EMBODIMENTS

Figure 1:
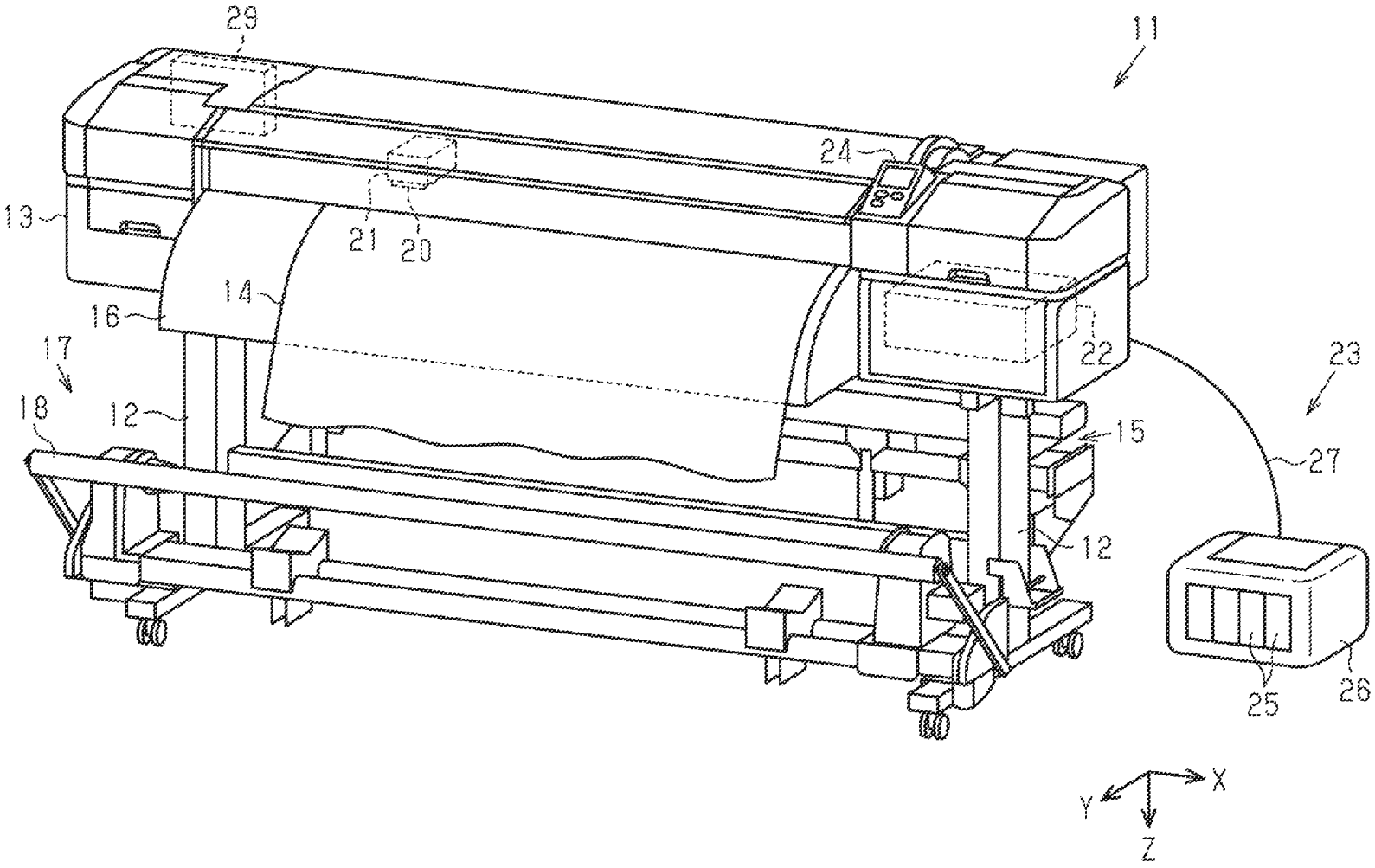
FIG. 1 is a perspective view of an exemplary embodiment of a liquid ejecting apparatus.

An exemplary embodiment of a wiping device and a liquid ejecting apparatus will be described below with reference to the drawings. The liquid ejecting apparatus is, for example, an ink jet-type printer configured to eject ink, which is an example of liquid, to perform printing on a medium such as a sheet.

In the drawings, a direction of gravity is indicated by a Z-axis while assuming that a liquid ejecting apparatus 11 is placed on a horizontal surface, and directions along the horizontal plane are indicated by an X-axis and a Y-axis. The X-, Y-, and Z-axes are orthogonal to each other. In the following description, a direction along the X-axis is also referred to as a width direction X, a direction along the Y-axis as a depth direction Y, and a direction along the Z-axis direction as a gravitational direction Z.

As illustrated in FIG. 1, the liquid ejecting apparatus 11 may include a pair of legs 12 and a housing 13 assembled on the legs 12. The liquid ejecting apparatus 11 may include a medium feeding portion 15 that unwinds and feeds a medium 14 wound in a roll shape, a guide unit 16 that guides the medium 14 discharged from the housing 13, and a collection unit 17 that winds and collects the medium 14. The liquid ejecting apparatus 11 may include a tension apply mechanism 18 that applies tension to the medium 14 collected by the collection unit 17.

The liquid ejecting apparatus 11 includes a liquid ejecting portion 20 capable of ejecting liquid, a carriage 21 that moves the liquid ejecting portion 20, and a maintenance unit 22 that maintains the liquid ejecting portion 20. The liquid ejecting apparatus 11 may include a liquid supply device 23 that supplies liquid to the liquid ejecting portion 20, and an operating panel 24 operated by a user. The carriage 21 reciprocates the liquid ejecting portion 20 along the X-axis.

The liquid ejecting portion 20 ejects liquid supplied through the liquid supply device 23 while moving, and performs printing on the medium 14.

The liquid supply device 23 may include a mounting portion 26 to which a plurality of liquid accommodation bodies 25 for accommodating liquid are detachably mounted, and a supply flow path 27 that supplies liquid to the liquid ejecting portion 20 from the liquid accommodation bodies 25 to be mounted to the mounting portion 26.

The liquid ejecting apparatus 11 includes a control unit 29 that controls operation of the liquid ejecting apparatus 11. The control unit 29 is constituted by including a CPU, a memory, and the like, for example. The control unit 29 controls the liquid ejecting portion 20, the liquid supply device 23, the maintenance unit 22, and the like, by the CPU executing a program stored in the memory.

Figure 2:
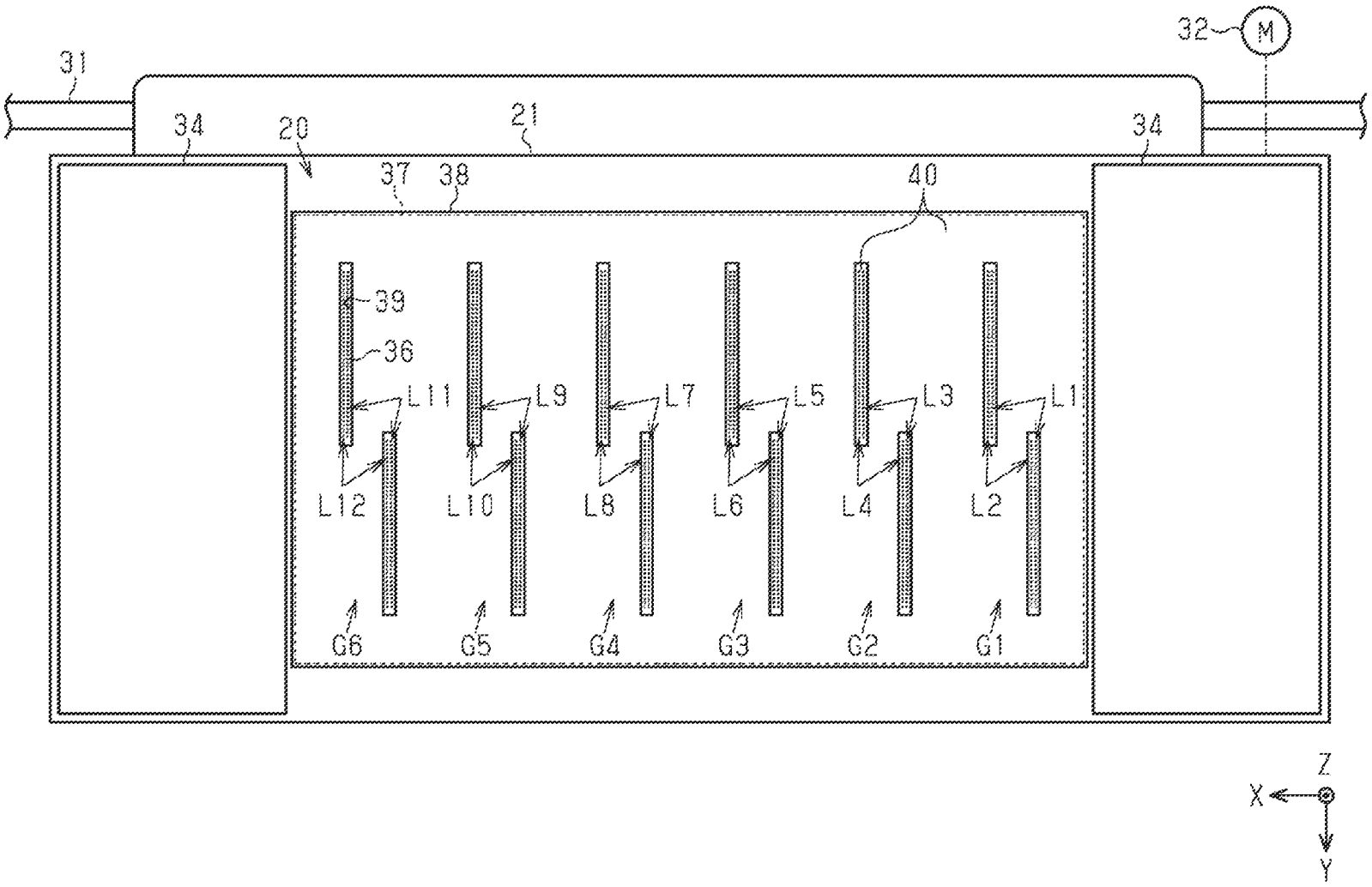
FIG. 2 is a schematic bottom view of a liquid ejecting portion and a carriage.

As illustrated in FIG. 2, the liquid ejecting apparatus 11 may include a guide shaft 31 that supports the carriage 21, and a carriage motor 32 that moves the carriage 21. The guide shaft 31 extends in the width direction X. The control unit 29 reciprocates the carriage 21 and the liquid ejecting portion 20 along the guide shaft 31, by controlling driving of the carriage motor 32.

The liquid ejecting apparatus 11 may include a wind stabilizer 34 held in a lower portion of the carriage 21. When the wind stabilizers 34 are provided at both sides of the liquid ejecting portion 20 in the width direction X, an air flow around the liquid ejecting portion 20 that reciprocates along the X-axis can be easily adjusted.

The liquid ejecting portion 20 may include a nozzle forming member 37 at which a plurality of nozzles 36 are formed, and a cover member 38 that covers a part of the nozzle forming member 37. The cover member 38 is formed of metal such as stainless steel, for example. A plurality of through holes 39 penetrating through the cover member 38 in the gravitational direction Z are formed in the cover member 38. The cover member 38 covers a side in the nozzle forming member 37 at which an opening of the nozzle 36 is formed, so that the nozzle 36 is exposed from the through hole 39. A nozzle surface 40 is formed including the nozzle forming member 37 and the cover member 38. Specifically, the nozzle surface 40 is constituted by the nozzle forming member 37 that is exposed from the through hole 39, and the cover member 38. The liquid ejecting portion 20 can eject liquid from the nozzle 36 disposed on the nozzle surface 40.

In the liquid ejecting portion 20, a large number of the openings of the nozzles 36 that eject liquid are arranged in one direction at regular intervals. The plurality of nozzles 36 constitute a nozzle row. In the present exemplary embodiment, the openings of the nozzles 36 are arranged in the depth direction Y, and constitute a first nozzle row L1 to a twelfth nozzle row L12. The nozzles 36 constituting one nozzle row eject the same type of liquid. Of the nozzles 36 constituting one nozzle row, the nozzle 36 located at a back in the depth direction Y and the nozzle 36 located at a front in the depth direction Y are formed such that positions thereof are shifted away from each other in the width direction X.

The first nozzle row L1 to the twelfth nozzle row L12 are arranged such that pairs of rows are adjacent to each other in the width direction X. In the present exemplary embodiment, two nozzle rows arranged adjacent to each other are referred to as a nozzle group. A first nozzle group G1 to a sixth nozzle group G6 are disposed in the liquid ejecting portion 20 at regular intervals in the width direction X.

Specifically, the first nozzle group G1 includes the first nozzle row L1 that ejects a magenta ink and the second nozzle row L2 that ejects a yellow ink. The second nozzle group G2 includes the third nozzle row L3 that ejects a cyan ink and the fourth nozzle row L4 that ejects a black ink. The third nozzle group G3 includes the fifth nozzle row L5 that ejects a light cyan ink and the sixth nozzle row L6 that ejects a light magenta ink. The fourth nozzle group G4 includes the seventh nozzle row L7 and an eighth nozzle row L8 that each eject a treatment liquid. The fifth nozzle group G5 includes the ninth nozzle row L9 that ejects the black ink and the tenth nozzle row L10 that ejects the cyan ink. The sixth nozzle group G6 includes the eleventh nozzle row L11 that ejects the yellow ink and the twelfth nozzle row L12 that ejects the magenta ink.

Next, the maintenance unit 22 will be described.

Figure 3:
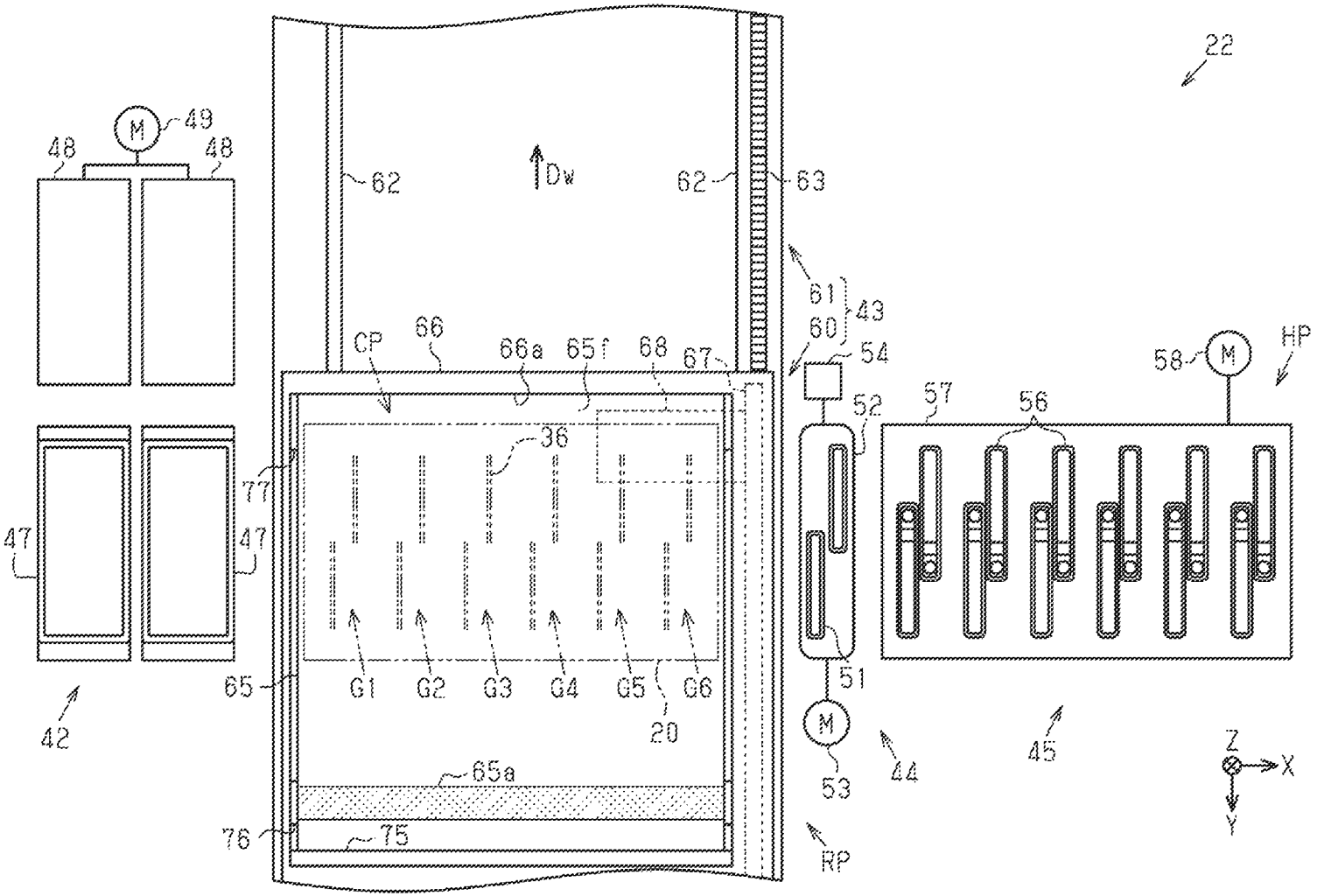
FIG. 3 is a schematic plan view of a maintenance device.

As illustrated in FIG. 3, the maintenance unit 22 includes a flushing device 42, a wiping device 43, a suction device 44, and a capping device 45 arranged in the width direction X. An upside of the capping device 45 is a home position HP of the liquid ejecting portion 20. The home position HP is a start of movement of the liquid ejecting portion 20. An upside of the wiping device 43 is a cleaning position CP of the liquid ejecting portion 20. In FIG. 3, the liquid ejecting portion 20 located at the cleaning position CP is illustrated by a double dot chain line. The wiping device 43 is provided so as to be capable of wiping the nozzle surface 40 of the liquid ejecting portion 20 located at the cleaning position CP.

The flushing device 42 accommodates liquid ejected from the liquid ejecting portion 20 by flushing. The flushing is maintenance in which liquid is ejected as a waste liquid for the purpose of preventing and resolving clogging of the nozzle 36.

The flushing device 42 includes a liquid accommodating unit 47 for accommodating the liquid ejected by the liquid ejecting portion 20 for the flushing, a lid member 48 for covering an opening of the liquid accommodating unit 47, and a lid motor 49 for moving the lid member 48. The flushing device 42 may include a plurality of the liquid accommodating units 47, and a plurality of the lid members 48. The control unit 29 may select the liquid accommodating unit 47 depending on a type of liquid. The flushing device 42 of the present exemplary embodiment includes two liquid accommodating units 47, one liquid accommodating unit 47 accommodates a plurality of color inks ejected by flushing from the liquid ejecting portion 20, and another liquid accommodating unit 47 accommodates the treatment liquid to be flushed by flushing from the liquid ejecting portion 20. The liquid accommodating unit 47 may accommodate a moisturizing liquid.

The lid member 48 is moved between a covering position (not illustrated) for covering the opening of the liquid accommodating unit 47 by driving of the lid motor 49, and an exposing position illustrated in FIG. 3 for exposing the opening of the liquid accommodating unit 47. When the flushing is not performed, the lid member 48 moves to the covering position, thereby suppressing drying of the accommodated moisturizing liquid and accommodated liquid.

The suction device 44 includes a suction cap 51, a suction holding body 52 that holds the suction cap 51, a suction motor 53 that reciprocates the suction holding body 52 along the Z-axis, and a vacuum mechanism 54 that depressurizes an inside of the suction cap 51. As the suction holding body 52 is moved by the suction motor 53, the suction cap 51 moves between a contact position and a retracted position. The contact position is a position where the suction cap 51 contacts the liquid ejecting portion 20 and surrounds the nozzle 36. The retracted position is a position where the suction cap 51 is away from the liquid ejecting portion 20.

The suction cap 51 may be configured to collectively surround all of the nozzles 36, may be configured to surround at least one nozzle group, or may be configured to surround some of the nozzles 36 among the nozzles 36 constituting the nozzle group. The suction device 44 of the present exemplary embodiment surrounds one nozzle group of the first nozzle group G1 to the sixth nozzle group G6 by two suction caps 51.

The liquid ejecting apparatus 11 may perform suction cleaning in which the liquid ejecting portion 20 is located above the suction device 44, the suction cap 51 is located in the contact position and surrounds one nozzle group, and the inside of the suction cap 51 is depressurized to discharge liquid from the nozzle 36. That is, the suction device 44 may accommodate liquid discharged by the suction cleaning.

The capping device 45 has a standby cap 56, a standby holding body 57 for holding the standby cap 56, and a standby motor 58 for reciprocating the standby holding body 57 along the Z-axis. As the standby holding body 57 is moved by the standby motor 58, the standby cap 56 moves upward or downward. The standby cap 56 is moved from a separated position that is a lower position, to a capping position that is an upper position, and contacts the liquid ejecting portion 20 that is stopped at the home position HP.

The standby cap 56 located at the capping position surrounds the openings of the nozzles 36 constituting the first nozzle group G1 to the sixth nozzle group G6. In this manner, the maintenance in which the standby cap 56 surrounds the opening of the nozzle 36 is referred to as standby capping. The standby capping is a type of capping. By the standby capping, drying of the nozzle 36 is suppressed.

The standby cap 56 may be configured to collectively surround all of the nozzles 36, may be configured to surround at least one nozzle group, or may be configured to surround some of the nozzles 36 among the nozzles 36 constituting the nozzle group.

Next, the wiping device 43 will be described.

As illustrated in FIG. 3, the wiping device 43 may include a wiping body 60, and a track 61 that movably supports the wiping body 60. The track 61 includes a pair of rails 62 extending along the Y-axis and a rack 63 extending along the Y-axis.

The wiping body 60 may include a band-like member 65 that is capable of absorbing liquid ejected by the liquid ejecting portion 20, a case 66 that accommodates the band-like member 65, and a power transmission mechanism 67 and a wiping motor 68 provided in the case 66. The wiping body 60 moves on the track 61 between a waiting position WP illustrated in FIG. 4 and a receiving position RP illustrated in FIG. 3.

The case 66 has an opening 66*a* that exposes a part of the band-like member 65. A size of the band-like member 65 in the width direction X may be greater than or equal to a size of the nozzle surface 40. In this case, the liquid ejecting portion 20 can be efficiently maintained.

When the wiping body 60 is located at the receiving position RP and the liquid ejecting portion 20 is located at the cleaning position CP, a first surface 65*f* of the band-like member 65 faces the nozzle surface 40. In this state, the liquid ejecting apparatus 11 may perform pressure cleaning to discharge pressurized liquid from the nozzle 36. That is, the wiping device 43 may accommodate liquid discharged by the pressure cleaning.

The wiping body 60 located at the waiting position WP is moved in the depth direction Y toward the receiving position RP by the wiping motor 68 being driven in a reverse direction. The wiping body 60 located at the receiving position RP moves in a wiping direction Dw that is opposite to the depth direction Y toward the waiting position WP by the wiping motor 68 being driven in a forward direction.

The wiping direction Dw is a direction in which the contact portion 65*a* of the band-like member 65 moves relative to the liquid ejecting portion 20 in a state of being in contact with the liquid ejecting portion 20. In FIG. 3, the contact portion 65*a* is illustrated by shading. The wiping device 43 of the present exemplary embodiment performs a wiping operation by moving the wiping body 60 in the wiping direction Dw with the liquid ejecting portion 20 stopped at the cleaning position CP. In the wiping operation, the first surface 65*f* of the contact portion 65*a* of the band-like member 65 contacts the nozzle surface 40 and wipes the nozzle surface 40. The band-like member 65 collects liquid adhering to the nozzle surface 40 by the wiping operation.

Figure 4:
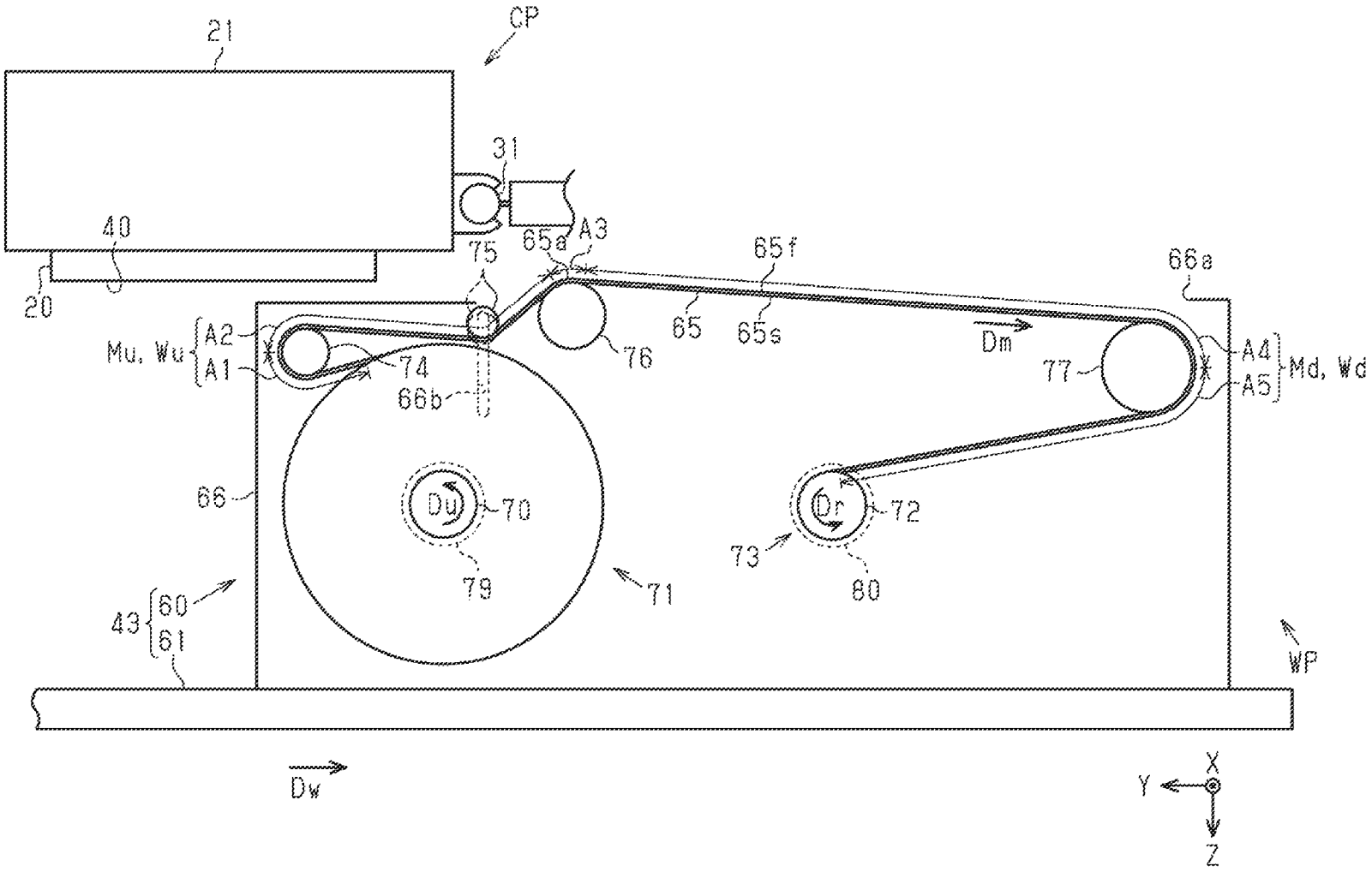
FIG. 4 is a schematic side diagram of a wiping device.

As illustrated in FIG. 4, the wiping device 43 includes a feeding portion 71 having a feeding shaft 70, and a winding portion 73 having a winding shaft 72. The feeding portion 71 holds the band-like member 65 in a state of being wound in a roll shape. The wiping device 43 may include an upstream roller 74, a contact unit 75, a pressing unit 76, and a downstream roller 77 that are provided in order from upstream along a movement region of the band-like member 65. The upstream roller 74, the contact unit 75, the pressing unit 76, and the downstream roller 77 are arranged in this order from upstream in the wiping direction Dw.

The band-like member 65 fed from the feeding portion 71 is wound in an order of the upstream roller 74, the contact unit 75, the pressing unit 76, and the downstream roller 77, and is wound around the winding portion 73. The case 66 rotatably supports the feeding shaft 70, the upstream roller 74, the contact unit 75, the pressing unit 76, the downstream roller 77, and the winding shaft 72 with the X-axis as an axial direction. The contact unit 75 contacts the first surface 65*f* of the band-like member 65. The upstream roller 74, the pressing unit 76, and the downstream roller 77 contact a second surface 65*s* opposite to the first surface 65*f* of the band-like member 65.

The winding shaft 72 rotates in a rewinding direction Dr by the wiping motor 68 being driven while the case 66 is located at the waiting position WP or the receiving position RP, and winds the band-like member 65 in a roll shape. In the present exemplary embodiment, the operation in which the winding portion 73 winds the band-like member 65 around the winding shaft 72 is referred to as a winding operation, and a region between the feeding portion 71 and the winding portion 73 is referred to as a movement region. By performing the winding operation, the winding portion 73 pulls the band-like member 65, and rotates the feeding shaft 70 in an feeding direction Du. The winding portion 73 moves a pulled-out portion of the band-like member 65 in a movement direction Dm along the movement region. The winding portion 73 is capable of moving the contact portion 65*a* in the movement direction Dm, by performing the winding operation for winding the band-like member 65. The movement direction Dm is a direction along the movement region and is a direction from the feeding portion 71 upstream toward the winding portion 73 downstream.

The wiping device 43 includes a brake mechanism 79 that brakes rotation of the feeding shaft 70 in the feeding direction Du in which the band-like member 65 is fed from the feeding shaft 70. The brake mechanism 79 may brake the rotation of the feeding shaft 70 by applying frictional force to the feeding shaft 70, for example, or may use a torque damper. The winding portion 73 and the brake mechanism 79 apply tension in the movement direction Dm to the band-like member 65 by the winding operation. The winding portion 73 winds the band-like member 65 applied with tension by the winding operation.

The wiping device 43 may include rotation restricting mechanism 80 that restricts rotation of the winding shaft 72 in a direction opposite to the rewinding direction Dr. The rotation restricting mechanism 80 allows rotation of the winding shaft 72 in the rewinding direction Dr associated with the winding operation, and restricts rotation of the winding shaft 72 when the winding operation is not performed.

The movement region has an feeding region A1, an immediately preceding region A2, a contact region A3, an immediately following region A4, and a winding region A5 that are arranged in order from upstream in the movement direction Dm. The feeding region A1 and the immediately preceding region A2 are a movement direction upstream region Mu upstream of the pressing unit 76 in the movement direction Dm of the movement region, and are also a wiping direction upstream region Wu upstream of the pressing unit 76 in the wiping direction Dw of the movement region. The immediately following region A4 and the winding region A5 are a movement direction downstream region Md downstream of the pressing unit 76 in the movement direction Dm of the movement region, and is also a wiping direction downstream region Wd downstream of the pressing unit 76 in the wiping direction Dw of the movement region.

The feeding region A1 is a region from the feeding portion 71 to the upstream roller 74. The immediately preceding region A2 is a region from the upstream roller 74 to the pressing unit 76. The immediately preceding region A2 is adjacent to the feeding region A1 and the contact region A3 in the movement direction Dm.

The contact region A3 is a region where the band-like member 65 is wound on the pressing unit 76, and the pressing unit 76 presses the band-like member 65 upward. Of the band-like member 65, a portion located in the contact region A3 is the contact portion 65*a*. The pressing unit 76 presses the contact portion 65*a* located in the contact region A3 of the band-like member 65 to allow the contact portion 65*a* to contact the liquid ejecting portion 20.

The immediately following region A4 is a region from the pressing unit 76 to the downstream roller 77. The immediately following region A4 faces the liquid ejecting portion 20 located at the cleaning position CP, when the wiping body 60 is located at the receiving position RP. The immediately following region A4 is adjacent to the contact region A3 and the winding region A5 in the movement direction Dm. The winding region A5 is a region from the downstream roller 77 to the winding portion 73.

The contact unit 75 contacts the band-like member 65 fed from the feeding portion 71 in the movement region between the feeding portion 71 and the winding portion 73 in the movement direction Dm, and applies tension to the band-like member 65. The contact unit 75 of the present exemplary embodiment is provided so as to contact the band-like member 65 in the immediately preceding region A2. In other words, the contact unit 75 contacts the band-like member 65 in the wiping direction upstream region Wu, and contacts the band-like member 65 in the movement direction upstream region Mu. The contact unit 75 contacts the band-like member 65 from above, and presses the band-like member 65 by weight of the contact unit to apply tension to the band-like member 65.

The case 66 may have a guide 66*b* for guiding the contact unit 75. The case 66 movably supports the contact unit 75. The contact unit 75 is movable between the operating time position indicated by a solid line in FIG. 4 during the winding operation and the stop time position indicated by a double dot chain line in FIG. 4 when the winding operation is not performed.

Next, actions of the present exemplary embodiment will be described.

As illustrated in FIG. 4, when the winding operation is performed, magnitude of the tension applied to the band-like member 65 in the movement region is greater than the force that the contact unit 75 presses the band-like member 65 by weight of the contact unit. As such, the contact unit 75 is pressed up by the band-like member 65, and is located at the operating time position above the stop time position.

When the winding operation is performed while the band-like member 65 is applied with tension, slack may occur in the band-like member 65 after the winding operation is performed. As such, when the winding operation ends, the contact unit 75 moves to the stop time position below the operating time position by weight of the contact unit, and absorbs the slack of the band-like member 65.

The slack in the band-like member 65 includes slack caused by rotation of the winding shaft 72 in the direction opposite to the rewinding direction Dr by a play angle, for example, from the end of the winding operation until the rotation restricting mechanism 80 functions. As a result, an amount of the slack of the band-like member 65 changes depending on an amount of the band-like member 65 wound around the winding shaft 72.

As illustrated in FIG. 4, when the amount of the band-like member 65 wound around the winding shaft 72 is small, a diameter of the band-like member 65 is small. As a result, when the winding shaft 72 is rotated by the play angle, an amount of the band-like member 65 that returns from the winding portion 73 to the movement region is small, and slack is also small. Thus, with respect to the operating time position indicated by the solid line in FIG. 4, the stop time position indicated by the double dot chain line in FIG. 4 is a close position.

Figure 5:
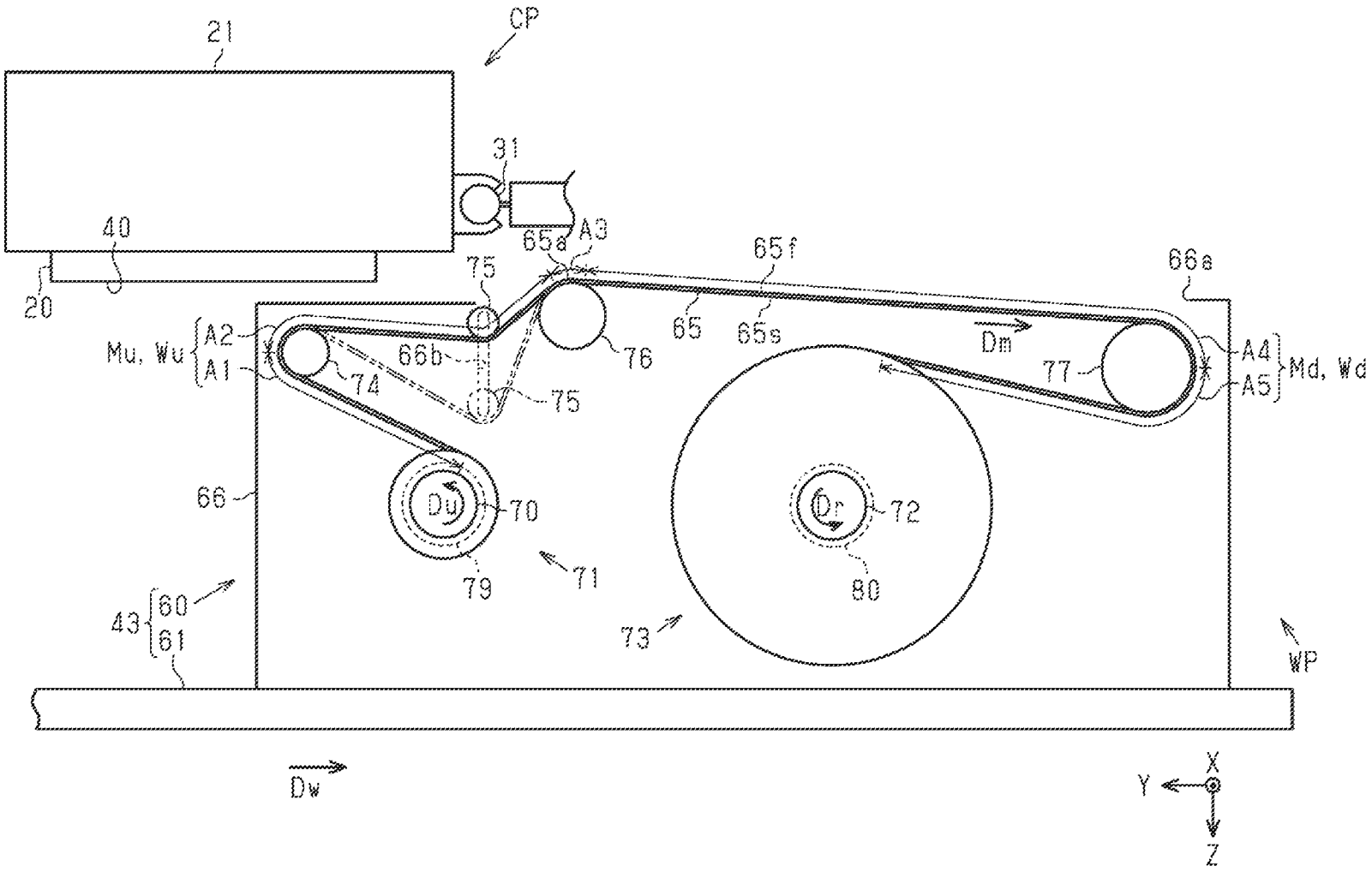
FIG. 5 is a schematic side diagram of the wiping device.

As illustrated in FIG. 5, when the amount of the band-like member 65 wound around the winding shaft 72 is large, the diameter of the band-like member 65 is large. As a result, when the winding shaft 72 is rotated by the play angle, the amount of the band-like member 65 that returns from the winding portion 73 to the movement region is large, and slack is also large. Thus, with respect to the operating time position indicated by a solid line in FIG. 5, the stop time position indicated by a double dot chain line in FIG. 5 is a distant position.

Specifically, as a diameter of the band-like member 65 wound around the winding portion 73 increases as the winding shaft 72 winds the band-like member 65, the diameter of the band-like member 65 of the feeding portion 71 decreases, and an amount of slack of the band-like member 65 after the winding operation is performed increases. Thus, as the diameter of the band-like member 65 wound around the feeding shaft 70 decreases, the stop time position is located at a lower position. As a result, the wiping device 43 can be made smaller by providing the contact unit 75 above the feeding portion 71, and superposing a space for accommodating the band-like member 65 wound around the feeding shaft 70 and a movement range of the contact unit 75.

Effects of the present exemplary embodiment will now be described.

(1) The contact unit 75 is located at the operating time position during the winding operation, and is located at the stop time position when the winding operation is not performed. In other words, when the winding operation ends, the contact unit 75 moves from the operating time position to the stop time position. Thus, by configuring the direction of movement from the operating time position to the stop time position to be a direction in which slack of the band-like member 65 is reduced, slack of the band-like member 65 that occurs after the winding operation is performed while the brake mechanism 79 applies tension to the band-like member 65 can be reduced.

(2) When the contact portion 65*a* of the band-like member 65 located in the contact region A3 slacks, there is a possibility that the contact portion 65*a* cannot be brought in good contact with the liquid ejecting portion 20. In that regard, the contact unit 75 contacts the immediately preceding region A2 of the band-like member 65 and applies tension to the band-like member 65. Since the immediately preceding region A2 is adjacent to the contact region A3, slack of the contact portion 65*a* can be made likely to be reduced.

(3) The contact unit 75 moves from the operating time position to the stop time position by weight of the contact unit. As a result, tension in accordance with the weight of the contact unit 75 can be stably applied to the band-like member 65.

(4) When the wiping operation is performed in which the contact portion 65*a* moves relative to the liquid ejecting portion 20 in the wiping direction Dw, liquid adhering to the liquid ejecting portion 20 tends to adhere to the wiping direction Dw downstream region downstream of the pressing unit 76 in the wiping direction Dw of the band-like member 65. In that regard, the contact unit 75 contacts the band-like member 65 in the wiping direction upstream region Wu upstream of the pressing unit 76 in the wiping direction Dw. As a result, liquid collected by the band-like member 65 by the wiping operation can be made less likely to adhere to the contact unit 75.

(5) The contact portion 65*a* that contacts the liquid ejecting portion 20 moves downstream in the movement direction Dm by the winding operation. In that regard, because the contact unit 75 contacts the movement direction upstream region Mu upstream of the pressing unit 76 in the movement direction Dm, liquid collected by the band-like member 65 can be made less likely to adhere to the contact unit 75.

The present exemplary embodiment described above may be modified as follows. The present exemplary embodiment and modified examples thereof to be described below may be implemented in combination within a range in which a technical contradiction does not arise.

The wiping device 43 may include two pressing units 76 arranged in the movement direction Dm, and a region between the two pressing units 76 may be the contact region A3.

The wiping device 43 may be configured to not include the rotation restricting mechanism 80. For example, the control unit 29 may control the driving of the wiping motor 68, and apply torque to the winding shaft 72 even when the winding operation is not performed. The control unit 29 may rotate the winding shaft 72 by increasing the torque applied to the winding shaft 72, and perform the winding operation.

The wiping device 43 may include a plurality of the contact units 75.

The contact unit 75 may contact the band-like member 65 in the wiping direction downstream region Wd. The contact unit 75 may contact the band-like member 65 in the movement direction downstream region Md. For example, the contact unit 75 may be provided so as to contact the band-like member 65 in the immediately following region A4 adjacent to the contact region A3 in the movement direction Dm. When the contact unit 75 contacts the band-like member 65 in the immediately following region A4 and applies tension to the band-like member 65, the contact region A4 is adjacent to the contact region A3, as a result, slack of the contact portion 65*a* can be made likely to be reduced.

The wiping device 43 may accommodate liquid ejected from the liquid ejecting portion 20 by flushing. For example, the band-like member 65 may accommodate liquid in the immediately following region A4. The contact unit 75 may contact the band-like member 65 between the pressing unit 76 and a position at which the liquid by flushing is accommodated in the movement direction Dm.

The contact unit 75 may be provided so as to contact the band-like member 65 in the feeding region A1. At this time, the contact unit 75 may contact the second surface 65*s* opposite to the first surface 65*f* at which the contact portion 65*a* contacts the liquid ejecting portion 20. By the contact unit 75 contacting the second surface 65*s*, when a portion contacted by the contact unit 75 moves in the movement direction Dm and becomes the contact portion 65*a*, a possibility of the first surface 65*f* of the contact portion 65*a* being soiled can be reduced.

The contact unit 75 may be provided so as to contact the band-like member 65 in the winding region A5. The contact unit 75 may be provided so as to contact the second surface 65*s* of the band-like member 65 in the movement direction downstream region Md. As a result, even when a portion that collects liquid by the wiping operation is moved in the movement direction Dm, the contact unit 75 contacts the second surface 65*s* of the band-like member 65 opposite to the first surface 65*f* in contact with the liquid ejecting portion 20. Accordingly, variations in a sliding load and the like between the contact unit 75 and the band-like member 65 can be reduced.

The wiping body 60 may move in the depth direction Y to wipe the liquid ejecting portion 20. In this case, the depth direction Y is the wiping direction Dw, and the feeding region A1 and the immediately preceding region A2 become the wiping direction downstream region Wd, and the immediately following region A4 and the winding region A5 are the wiping direction upstream region Wu.

The wiping device 43 may include a pressing member such as a spring or a weight that presses the contact unit 75 against the band-like member 65. When the pressing member is a spring, the stop time position may be located above the operating time position in a vertical direction. The contact unit 75 may move in a horizontal direction.

The wiping operation may be performed by moving the liquid ejecting portion 20 relative to the contact portion 65*a* that is stopped. The wiping operation may be performed by moving both the contact portion 65*a* and the liquid ejecting portion 20.

The liquid ejecting apparatus 11 may be a liquid ejecting apparatus that ejects or discharges other liquids other than ink. States of liquid discharged from the liquid ejecting apparatus as a small amount of droplets include granular, tear-like, and string-like with a tail. The liquid described herein may be any material as far as the material can be ejected from the liquid ejecting apparatus. For example, it is sufficient that the liquid is a substance that is in a state of being in a liquid phase, and the liquid includes fluid bodies such as a liquid body with high or low viscosity, sol, gel water, other inorganic solvents, organic solvents, solutions, liquid resins, liquid metals, and metal melts. The liquid includes not only liquid as a state of a substance, but also particles of functional material consisting of solid substances such as pigments and metal particles that are dissolved, dispersed, or mixed in a solvent. Representative examples of the liquid include ink, liquid crystal, and the like described in the above exemplary embodiment. Here, the ink includes, a general aqueous ink and a solvent ink, and various liquid compositions such as a gel ink and a hot-melt ink. For example, as a specific example of the liquid ejecting apparatus, there is a device that ejects liquid including materials such as an electrode material and a color material used in manufacture of liquid crystal displays, electroluminescent displays, surface emitting displays, color filters and the like in a dispersed or dissolved form. The liquid ejecting apparatus may be a device ejecting bioorganic substances used for biochip manufacturing, a device used as a precision pipette and ejecting liquid to be a sample, a printing apparatus, a micro dispenser, or the like. The liquid ejecting apparatus may be a device ejecting lubricant to a precision machine such as a clock or a camera in a pinpoint manner, or a device ejecting transparent resin liquid such as ultraviolet cure resin on a substrate for forming a tiny hemispherical lens, optical lens, or the like used for an optical communication element and the like. The liquid ejecting apparatus may be a device that ejects an etching solution, such as acid or alkali, to etch a substrate or the like.

Hereinafter, technical concepts and effects thereof that are understood from the above-described exemplary embodiments and modified examples will be described.

(A) A wiping device includes a feeding portion having a feeding shaft, and configured to hold a band-like member in a state of being wound in a roll shape, a pressing unit around which the band-like member fed from the feeding portion is wound, the pressing unit being configured to enable a contact portion, located in a contact region, of the band-like member to contact a liquid ejecting portion configured to eject liquid, a winding portion having a winding shaft, and configured to be capable of performing a winding operation for winding the band-like member to move the contact portion in a movement direction, a brake mechanism configured to brake rotation of the feeding shaft in a direction in which the band-like member is fed from the feeding shaft, and a contact unit configured to contact the band-like member fed from the feeding portion in a movement region between the feeding portion and the winding portion in the movement direction to apply tension to the band-like member, the contact unit being movable between an operating time position during the winding operation and a stop time position when the winding operation is not performed.

According to this configuration, the contact unit is located at the operating time position during the winding operation, and is located at the stop time position when the winding operation is not performed. In other words, when the winding operation ends, the contact unit moves from the operating time position to the stop time position. Thus, by configuring the direction of movement from the operating time position to the stop time position to be a direction in which slack of the band-like member is reduced, slack of the band-like member that occurs after the winding operation is performed while the brake mechanism applies tension to the band-like member can be reduced.

(B) In a wiping device, the contact unit may be provided so as to contact the band-like member in either the immediately preceding region or the immediately following region adjacent to the contact region in the movement direction.

When the contact portion of the band-like member located in the contact region slacks, there is a possibility that the contact portion cannot be brought in good contact with the liquid ejecting portion. In that regard, according to this configuration, the contact unit contacts the band-like member in either the immediately preceding region or the immediately following region to apply tension to the band-like member. Since the immediately preceding region and the immediately following region are adjacent to the contact region, slack of the contact portion can be made likely to be reduced.

(C) In a wiping device, the contact unit may be provided so as to be movable by weight of the contact unit from the operating time position to the stop time position below the operating time position.

According to this configuration, the contact unit moves from the operating time position to the stop time position by weight of the contact unit. As a result, tension in accordance with the weight of the contact unit can be stably applied to the band-like member.

(D) In a wiping device, when a direction in which the contact portion moves relative to the liquid ejecting portion in a state of being in contact with the liquid ejecting portion is a wiping direction, the contact unit may contact the band-like member in a wiping direction upstream region upstream of the pressing unit in the wiping direction of the movement region.

When the wiping operation is performed in which the contact portion moves relative to the liquid ejecting portion in the wiping direction, liquid adhering to the liquid ejecting portion tends to adhere to a wiping direction downstream region downstream of the pressing unit in the wiping direction of the band-like member. In this regard, according to this configuration, the contact unit contacts the band-like member in the wiping direction upstream region upstream of the pressing unit in the wiping direction. As a result, liquid collected by the band-like member by a wiping operation can be made less likely to adhere to the contact unit.

(E) In a wiping device, the contact unit may contact the band-like member in a movement direction upstream region upstream of the pressing unit in the movement direction of the movement region.

The contact portion that contacts the liquid ejecting portion moves downstream in the movement direction by the winding operation. In that regard, according to this configuration, because the contact unit contacts the movement direction upstream region upstream of the pressing unit in the movement direction, liquid collected by the band-like member can be made less likely to adhere to the contact unit.

(F) A liquid ejecting apparatus includes a liquid ejecting portion configured to eject liquid, and a wiping device capable of wiping the liquid ejecting portion, wherein the wiping device includes a feeding portion having a feeding shaft, and configured to hold a band-like member in a state of being wound in a roll shape, a pressing unit around which the band-like member fed from the feeding portion is wound, the pressing unit being configured to enable a contact portion, located in a contact region, of the band-like member to contact a liquid ejecting portion configured to eject liquid, a winding portion having a winding shaft, and configured to be capable of performing a winding operation for winding the band-like member to move the contact portion in a movement direction, a brake mechanism configured to brake rotation of the feeding shaft in a direction in which the band-like member is fed from the feeding shaft, and a contact unit configured to contact the band-like member fed from the feeding portion in a movement region between the feeding portion and the winding portion in the movement direction to apply tension to the band-like member, the contact unit being movable between an operating time position during the winding operation and a stop time position when the winding operation is not performed. According to this configuration, the same effect as the wiping device described above can be obtained.

(G) In a liquid ejecting apparatus, the contact unit may be provided so as to contact the band-like member in either an immediately preceding region or an immediately following region adjacent to the contact region in the movement direction. According to this configuration, the same effect as the wiping device described above can be obtained.

(H) In a liquid ejecting apparatus, the contact unit may be provided so as to be movable by weight of the contact unit from the operating time position to the stop time position below the operating time position. According to this configuration, the same effect as the wiping device described above can be obtained.

(I) In a liquid ejecting apparatus, when a direction in which the contact portion moves relative to the liquid ejecting portion in a state of being in contact with the liquid ejecting portion is a wiping direction, the contact unit may contact the band-like member in a wiping direction upstream region upstream of the pressing unit in the wiping direction of the movement region. According to this configuration, the same effect as the wiping device described above can be obtained.

(J) In a liquid ejecting apparatus, the contact unit may contact the band-like member in a movement direction upstream region upstream of the pressing unit in the movement direction of the movement region. According to this configuration, the same effect as the wiping device described above can be obtained.

What is claimed is:

1. A wiping device, comprising:

a feeding portion having a feeding shaft, and configured to hold a band-like member in a state of being wound in a roll shape;

a pressing unit around which the band-like member fed from the feeding portion is wound, the pressing unit being configured to bring a contact portion, located in a contact region, of the band-like member to contact a liquid ejecting portion configured to eject liquid;

a winding portion having a winding shaft, and configured to perform winding operation for winding the band-like member to move the contact portion in a movement direction;

a brake mechanism configured to brake rotation of the feeding shaft in a direction in which the band-like member is fed from the feeding shaft; and a contact unit which is disposed so as not to contact the pressing unit, the contact unit being configured to contact a region upstream or downstream from the contact region of the band-like member in the movement direction, the contact unit being configured to apply tension to the band-like member fed from the feeding portion by contacting to the band-like member, the contact unit being configured to move between an operating time position during the winding operation and a stop time position when the winding operation is not performed.

2. The wiping device according to claim 1, wherein the contact unit is provided so as to contact the band-like member in either an immediately preceding region or an immediately following region adjacent to the contact region in the movement direction.

3. The wiping device according to claim 1, wherein the contact unit is configured to move by weight of the contact unit from the operating time position to the stop time position below the operating time position.

4. The wiping device according to claim 1, wherein when a direction in which the contact portion moves relative to the liquid ejecting portion in a state of being in contact with the liquid ejecting portion is a wiping direction, the contact unit contacts the band-like member in a wiping direction upstream region upstream of the pressing unit in the wiping direction, in the movement region.

5. The wiping device according to claim 1, wherein the contact unit contacts the band-like member in a movement direction upstream region upstream of the pressing unit in the movement direction, in the movement region.

6. The wiping device according to claim 1, wherein in the band-like member, when a surface in contact with the liquid ejecting portion is a first surface and a surface in contact with the pressing unit is a second surface, the contact unit is in contact with the first surface of the band-like member.

7. The wiping device according to claim 1, wherein as an amount of the band-like member wound around the winding portion increases, the stop time position moves away from the operating time position.

8. A liquid ejecting apparatus, comprising:

a liquid ejecting portion configured to eject liquid; and a wiping device configured to wipe the liquid ejecting portion, wherein the wiping device includes a feeding portion having a feeding shaft, and configured to hold a band-like member in a state of being wound in a roll shape;

a pressing unit around which the band-like member fed from the feeding portion is wound, the pressing unit being configured to bring a contact portion, located in a contact region, of the band-like member to contact a liquid ejecting portion;

a winding portion having a winding shaft, and configured to perform winding operation for winding the band-like member to move the contact portion in a movement direction;

a brake mechanism configured to brake rotation of the feeding shaft in a direction in which the band-like member is fed from the feeding shaft; and a contact unit which is disposed so as not to contact the pressing unit, the contact unit being configured to contact a region upstream or downstream from the contact region of the band-like member in the movement direction, the contact unit being configured to apply tension the band-like member fed from the feeding portion by contacting to the band-like member, the contact unit being configured to move between an operating time position during the winding operation and a stop time position when the winding operation is not performed.

9. The liquid ejecting apparatus according to claim 8, wherein the contact unit is provided so as to contact the band-like member in either an immediately preceding region or an immediately following region adjacent to the contact region in the movement direction.

10. The liquid ejecting apparatus according to claim 8, wherein the contact unit is configured to move by weight of the contact unit from the operating time position to the stop time position below the operating time position.

11. The liquid ejecting apparatus according to claim 8, wherein when a direction in which the contact portion moves relative to the liquid ejecting portion in a state of being in contact with the liquid ejecting portion is a wiping direction, the contact unit contacts the band-like member in a wiping direction upstream region upstream of the pressing unit in the wiping direction, in the movement region.

12. The liquid ejecting apparatus according to claim 8, wherein the contact unit contacts the band-like member in a movement direction upstream region upstream of the pressing unit in the movement direction, in the movement region.

13. The liquid ejecting apparatus according to claim 8, wherein in the band-like member, when a surface in contact with the liquid ejecting portion is a first surface and a surface in contact with the pressing unit is a second surface, the contact unit is in contact with the first surface of the band-like member.

14. The liquid ejecting apparatus according to claim 8, wherein as an amount of the band-like member wound around the winding portion increases, the stop time position moves away from the operating time position.

* * * * *